US005319944A

United States Patent [19]

Uehara

[11] Patent Number: 5,319,944

[45] Date of Patent: Jun. 14, 1994

[54] ENGINE DRIVE AIR CONDITIONER

[75] Inventor: Yuzuru Uehara, Ann Arbor, Mich.

[73] Assignee: Gas Research Institute, Chicago, Ill.

[21] Appl. No.: 92,513

[22] Filed: Jul. 16, 1993

[30] Foreign Application Priority Data

Jul. 17, 1992 [JP] Japan ..... 4-190853

[51] Int. Cl.[5] ..... F25B 27/00

[52] U.S. Cl. ..... 62/228.4; 62/323.1

[58] Field of Search ..... 62/323.1, 228.4, 229

[56] References Cited

U.S. PATENT DOCUMENTS 5,018,362 5/1991 Nagase et al. ..... 62/323.1 X
5,168,713 12/1992 Howland ..... 62/228.4 X
5,199,272 4/1993 Yamanaka et al. ..... 62/228.4 X

*Primary Examiner*—William E. Wayner

*Attorney, Agent, or Firm*—Burns, Doane, Swecker & Mathis

[57] ABSTRACT

An engine driven air conditioner for adjusting a temperature of an inner space of a room, includes a coolant circuit having a compressor, a condenser, an expansion device and an evaporator, an engine for driving the compressor, and a control device for controlling the coolant circuit and the engine in such a manner that the engine is driven at its minimum power or at a power other than the minimum power. During operation the engine is stopped if the temperature exceeds a first set value while the engine is being driven at the minimum power, the engine is stopped if the temperature exceeds a second set value which is less than the first set value while the engine is being driven after the minimum power operation, and the engine is driven at the minimum power when the engine is re-started after a temporary stop of the engine.

3 Claims, 6 Drawing Sheets

ENGINE DRIVE AIR CONDITIONER

BACKGROUND OF THE INVENTION

1. Field of the Invention

The present invention relates to an engine driven air conditioner.

2. Description of the Prior Art

In general, an air conditioning is established in such a manner that an indoor temperature is adjusted to a temperature which is set by a user. In order to approach the set temperature, an engine is driven on the basis of the current indoor temperature, the set temperature, and other factors. In the conventional air conditioner, if the current temperature exceeds the set temperature as a result of the air conditioning, the engine is temporarily stopped. If the set temperature is too large relative to the current indoor temperature before the start of the air conditioning, excess air conditioning is established, which results in discomfort to the user. On the other hand, if the set temperature is not so high relative to the current indoor temperature before the start of the air conditioning, the set temperature is quickly approached as a result of the air conditioning, thereby stopping the engine soon after establishment of the air conditioning. Thus, frequent repetitive stopping and starting of the engine results, which is not desirable.

SUMMARY OF THE INVENTION

It is, therefore, an object of the present invention to provide an engine driven air conditioner without the foregoing drawbacks.

It is another object of the present invention to provide an engine driven air conditioner which is able to avoid establishment of excess air conditioning.

It is a further object of the present invention to provide an engine driven air conditioner without frequent repetitive stopping and starting of the engine.

In order to achieve these objects, there is provided an engine driven air conditioner for adjusting a temperature of an inner space of a room, which comprises a coolant circuit having a compressor, a condenser, an expansion device and an evaporator, an engine for driving the compressor, and a control device for controlling the coolant circuit and the engine in such a manner that the engine is driven at its minimum power or at a power other than the minimum power. During operation the engine is stopped if the temperature exceeds a first set value while the engine is being driven at the minimum power, the engine is stopped if the temperature exceeds a second set value which is less than the first set value while the engine is being driven after the minimum power operation, and the engine is driven at the minimum power when the engine is re-started after a temporary stop of the engine.

BRIEF DESCRIPTION OF THE DRAWINGS

Additional objects and advantages of the present invention will become more apparent from the following detailed description of preferred embodiments thereof when considered with a reference to the attached drawings, in which.

DETAILED DESCRIPTION OF THE INVENTION

Figure 1:
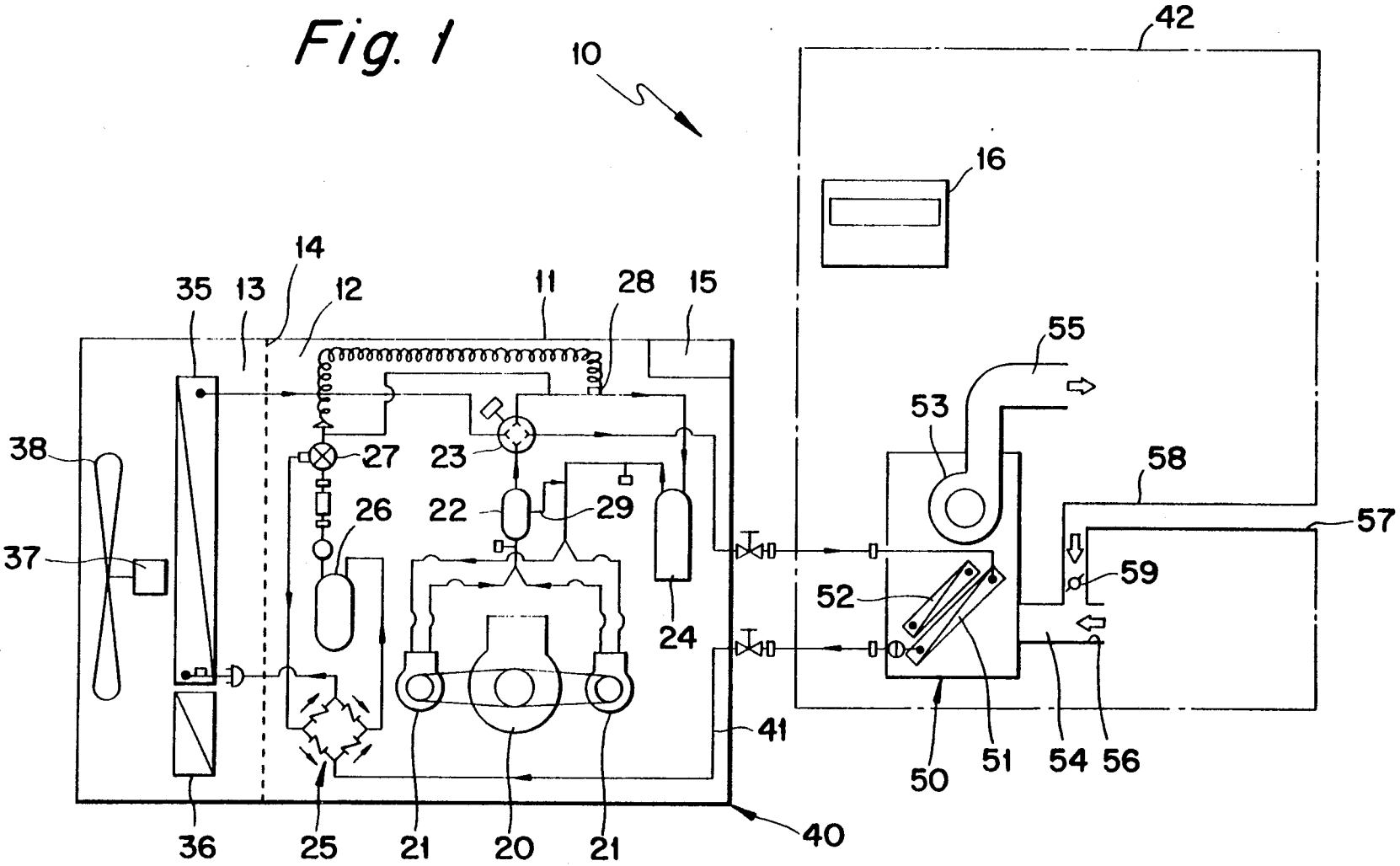
FIG. 1 show a structure of an engine driven air conditioner in accordance with the present invention.

Referring first to FIG. 1, an engine driven air conditioner 10 includes an outdoor device 11 and an indoor device 50. The outdoor device 11 has an inner space provided with a partition 14 which defines an engine chamber 12 and a heat-exchanger chamber 13. In the engine chamber 12, there are installed a pair of compressors 21, 21 both of which are driven by a common engine 20. Each compressor 21 is provided in a coolant circuit 41. In the engine room 12, there are accommodated an oil separator 22, a four-way valve 23, an accumulator 24, a one-way bridge 25, a receiver 26, and an expansion valve 27 which constitute the coolant circuit 41. The four-way valve 23 is used for bringing the air conditioner 10 from a cooling mode into a heating mode and vice versa. The expansion valve 27 is set to be adjusted on the basis of the temperature and pressure of a coolant at an intake side of the accumulator 24 which is disposed in the coolant circuit 41. In order to detect the temperature and the pressure of the coolant, a sensor 28 which is in the form of a cylinder is provided at the intake side of the accumulator 24. Oil separated from the coolant at the oil separator 22 is returned via a conduit 29 to each of the compressors 21.

On the other hand, in the heat-exchanger chamber 13, there are accommodated an outdoor heat-exchanger 35 and a radiator 36 both of which are provided in the coolant circuit 41. A fan 38 which is driven by a motor 37 establishes a heat-exchange between the coolant and the outdoor air. It is to be noted that the outdoor heat-exchanger 35 is used as a condenser and an evaporator when the air conditioner 10 is in the cooling mode and the heating mode, respectively.

The indoor device 50 is installed within a room 42 and has an indoor heat-exchanger 51 and a radiator 52. It is to be noted that indoor heat-exchanger 51 is used as a condenser and an evaporator when the air conditioner 10 is in the heating mode and the cooling mode, respectively. A fan 53 promotes a heat exchange between the outdoor air and an indoor air in such a manner that the indoor air taken into an inlet 54 is brought into heat-exchange with the coolant at the indoor heat-exchanger 51 and the radiator 52, and the resultant air is fed into the room 42 via an outlet 55. The inlet 54 is in fluid communication via a conduit 58 with a port 45 for introducing indoor air and a port 57 for introducing outdoor air. Within the conduit 58, there is provided a valve 59 for controlling fluid flow in the conduit 58.

It is to be noted that each arrow along the coolant circuit 41 denotes a fluid-flow direction of the coolant. The overall operation of the air conditioner 10 is under the control of an electric controller 15 which is at a side of the outdoor device 11. The controller 15 is expected to receive information from each component of the air conditioner 10 and a remote controller 16 handled by an operator or user within the room 42. An explanation of operation of the coolant circuit 40 will be omitted due to the fact that it is well-known.

Hereinbelow, with reference to FIGS. 2 through 6, an explanation concerning the control of the air conditioner 10 will be set forth in detail. It is to be noted that the following definitions are used throughout the Figures.

Toffset: offset temperature

Tsav: save temperature

Mode: mode issued from the remote controller 16

OPMode: real operation mode

Tset: set temperature issued from the remote controller 16

Troom: room temperature

OPTset: real operation temperature dT: absolute value of a difference between room temperature and real operation temperature Tmio: minimum operation time duration dTold: absolute value of a difference between room temperature and real operation temperature when immediately preceding real operation dTnew: absolute value of a difference between room temperature and real operation temperature when current preceding real operation Tmch: time duration at which mode switching is inhibited Tout: outdoor temperature Tjud: minimum operation time duration under minimum power $$|T3 \text{ (first set value)}| > |T2 \text{ (second set value)}|$$

$$T8 > T6,\ T7 > T9$$

$$|T10| > |T5|$$

Figure 2:
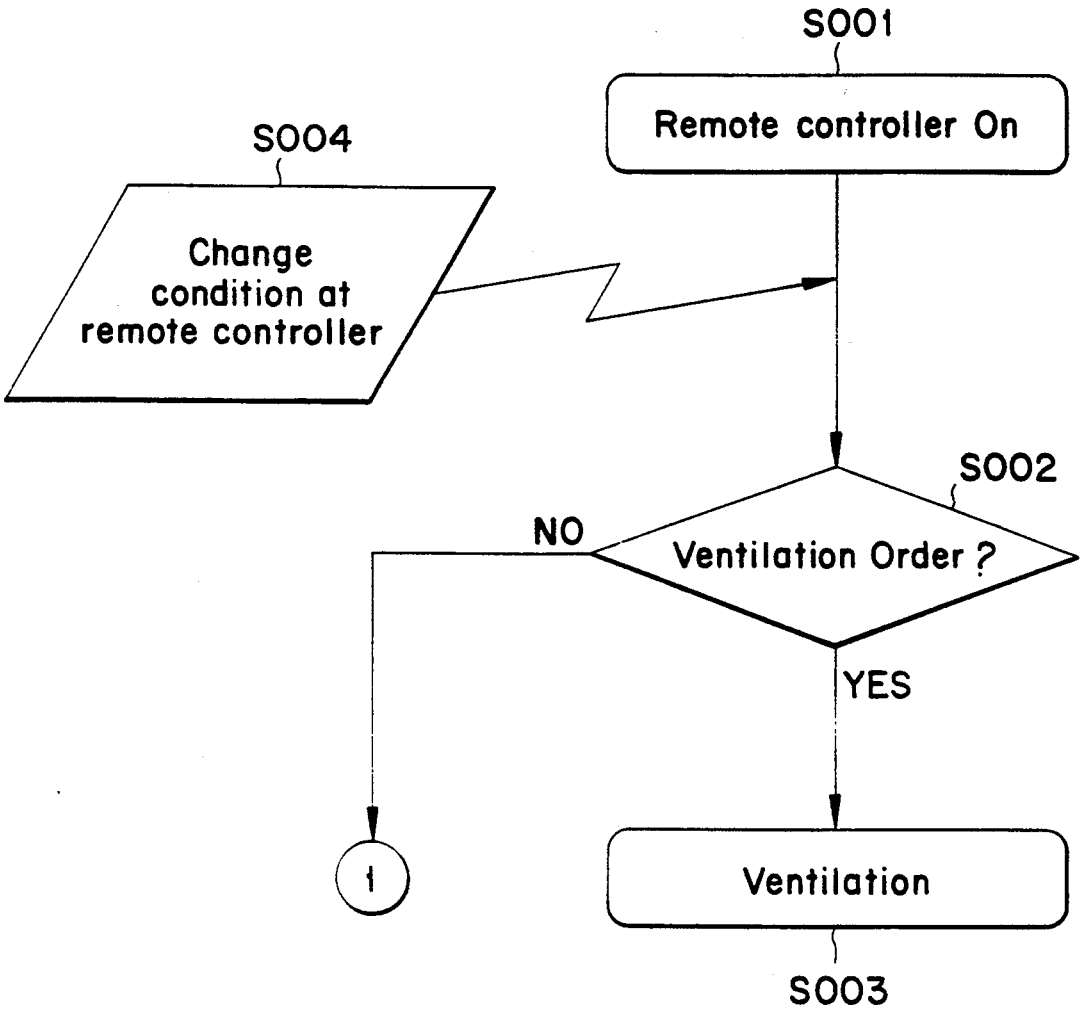
FIGS. 2 through 6 are flow-charts showing operation of an engine driven air conditioner.
Figure 3:
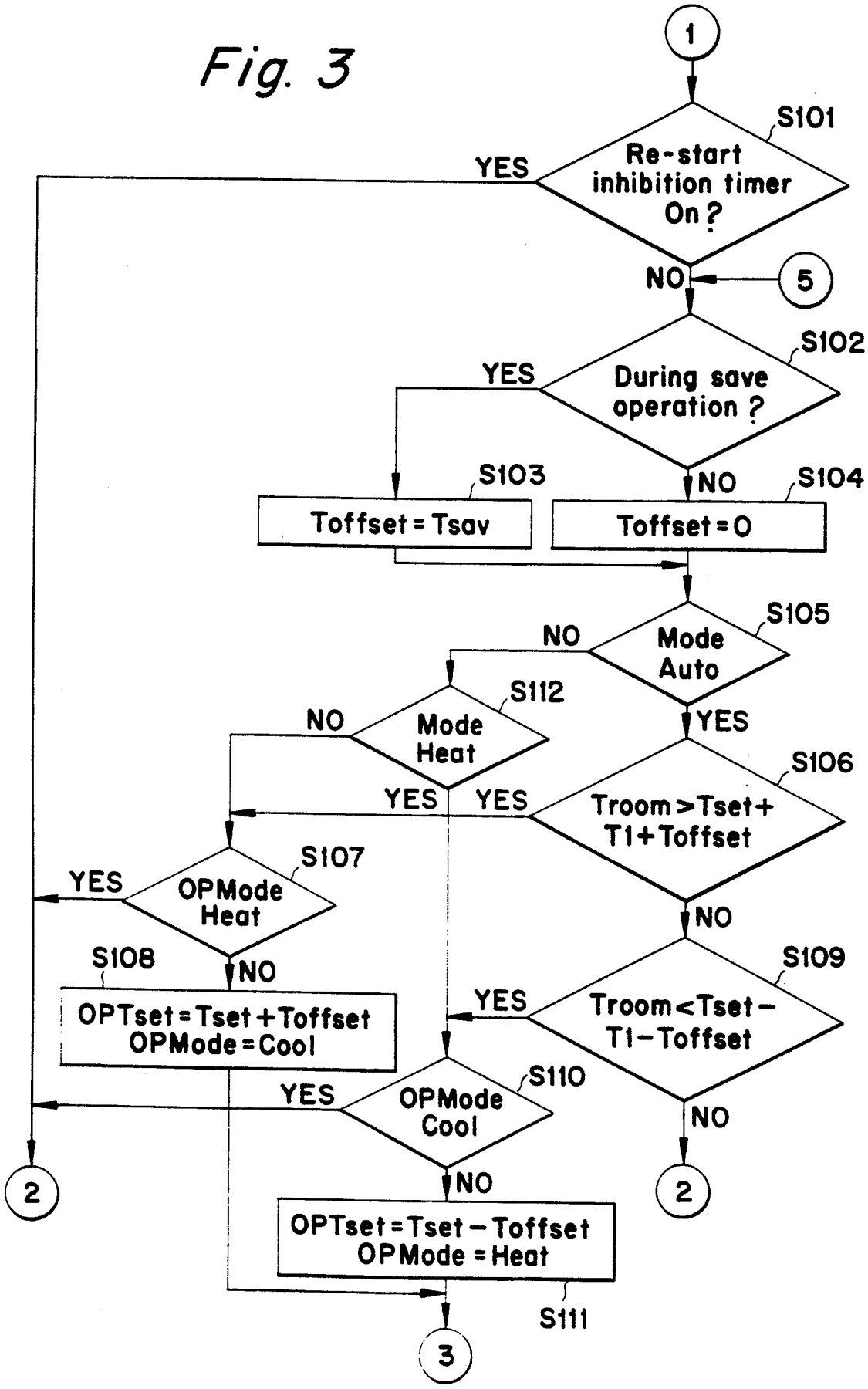
Figure 4:
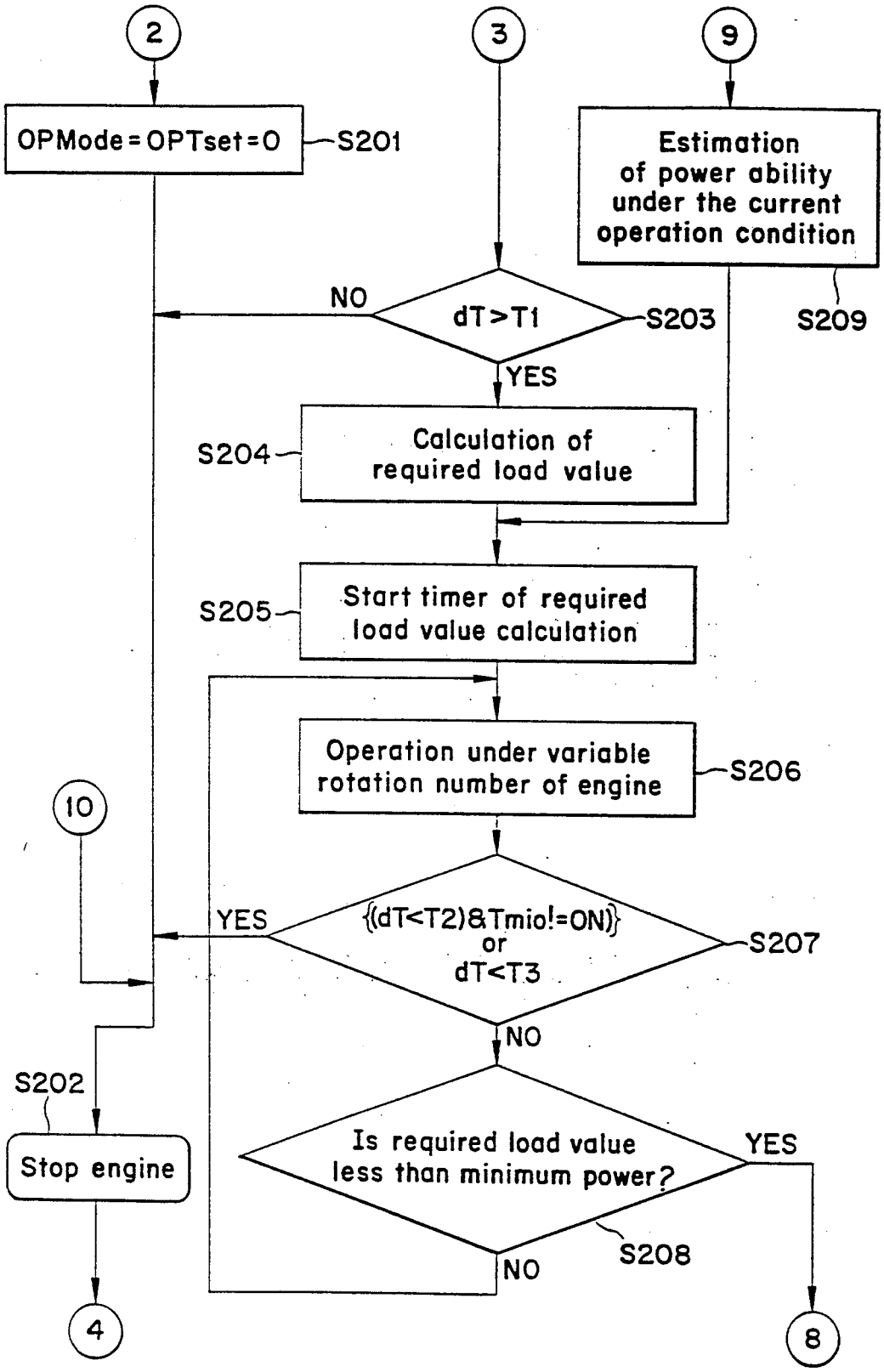

Referring first to FIG. 2, when an on-off switch of the remote controller 16 is turned on for initiating operation of the air conditioner 10, the remote controller 16 is brought into activation at step S001, thereby starting the control of the air conditioner 10. At step S002, it is judged whether the mode issued from the remote controller 16 is the ventilation mode. It is to be noted that other than the ventilation mode, there is an auto operation ("Auto"), a heating mode ("Heat"), and a cooling mode ("Cool"). At step S002, if the ventilation mode is recognized, the control proceeds to step S003 for ventilation operation. If no ventilation mode is recognized at step S002, the control proceeds to step S101 (FIG. 3). It is to be noted that when one of the set conditions is changed by the remote controller 16 the resultant condition always interrupts the control at step S004.

In FIG. 3, at step S101, it is determined whether a re-start inhibition timer is in the on condition. During the temperature adjustment by the air conditioner 10, if the difference between the indoor temperature (Troom) and the set temperature by the remote controller 16 (Tset) becomes a set value which will be detailed later, each operation of the engine 20 and the coolant circuit 41 is temporarily stopped. In order to protect the coolant circuit 41, a time duration between the stop of engine 20 (the coolant circuit 41) and the re-start of the engine 20 (the coolant circuit 41) is required. Thus, so long as the time duration has not elapsed, the re-start inhibition timer remains in the on-condition. If the re-start inhibition timer is in the on-condition at step S101, the control proceeds to step S201 (FIG. 4) at which OPMod and OPTset are set to be zero. Moreover, at step S202, the engine 20 remains at rest.

On the other hand, if the re-start inhibition timer is in the off-condition at step S101, it is determined whether the air conditioner 10 is under a save operation or not at step S102. If the save operation is (is not) recognized, at step S103 (S104), it is established that Toffset=Tsav ( Toffset=0). Next, at step S105, it is determined whether the mode is Auto. If the mode is Auto, it is determined at step S106 whether the following condition formula (1) is established.

$$Troom > (Tset + T1 + Toffset) \text{ where T is a constant} \quad (1)$$

If the condition formula (1) is established or is valid, Troom is greater than Tset by at least the sum of T1 and Toffset, which requires the cooling operation of the air conditioner 10. Thus, the control goes to step S107 at which it is checked whether the current OPMode is Heat or not. If it is, Troom becomes further greater than Tset, which is to be avoided. Thus, the control proceeds to step S201 for bringing OPMode and OPTset into zero, and at step S202 the engine 20 is stopped. In contrast, if the current OPMode is not Heat at step S107, the control proceeds to step S108 at which OPTset=Tset+Toffset and OPMode=Cool are established in order that the air conditioner 10 may be in the cooling operation mode. At step S106, when the condition formula (1) is invalid or not satisfied, step S109 is executed for determining whether the following condition formula (2) is valid or satisfied.

$$Troom < Tset - T1 - Toffset \quad (2)$$

If this condition formula is satisfied, Troom is less than Tset by at least the sum of T1−Toffset, which requires the heating operation of the air conditioner 10. Thus, the control proceeds to step S110 at which it is determined whether the current OPMode is Cool. If it is, Troom becomes further less than Tset, which is to be avoided. Thus, the control proceeds to step S201 for bringing OPMode and OPTset into zero, and at step S202 the engine 20 is stopped. In contrast, if the current OPMode is not Cool at step S110, the control proceeds to step S111 at which OPTset=Tset−Toffset and OPMode=Heat are established in order that the air conditioner 10 may be in the heating operation mode. If the condition formula (2) is invalid or not satisfied at step S109, step S201 is executed for bringing OPMode and OPTset to zero, and at step S202 the engine 20 is stopped.

At step S105, if the Mode is not Auto, the control proceeds to step S112 in order to check whether Mode is Heat. If it is not, steps S107 and S108 are executed as mentioned above. If the Mode is Heat, steps S110 and S111 are executed as mentioned above.

Upon completion of the execution of step S108 or step S111, the control proceeds to step S203 (FIG. 4) in order to check whether the condition formula (3) of dT>T1 is valid or satisfied. If it is not satisfied, due to the fact that Troom is nearly equal to Tset, step S202 is executed for stopping the engine 20. If the condition formula is satisfied at step S204, the required load value is calculated, and at step S205 the period timer for the required load value calculation is initiated.

Step S206, step S207, and step S208 are executed in a loop manner for establishing the ordinary operation of the air conditioner 10. Within this loop, under the establishment of the timer at step S205, the required load value calculations are intermittently established. That is to say, at step S206, the air conditioner 10 is driven under a condition that the rotational number of the engine 20 is variable. It is to be noted that the operation mode (OPMode) of the air conditioner 10 has been set at step S108 or step S111. At step S207, it is determined whether at least one of the following condition formulas (4) and (5) is valid or satisfied.

$$(dt < T2)\ \&\ (Tmio! = ON) \quad (4)$$

$$dT<T3 \quad (5)$$

It is to be noted that "!=" means "≠", T2 is a minus value indicating excess heating, and T3 is a minus value indicating excess cooling. Due to the fact that the absolute value of T2 is less than the absolute value of T3, a condition under which dT<T2 is more excessive than another condition under which dT<T3 in a cooling operation. When any one of the condition formulas (4) and (5) is valid or satisfied, Tset is attained, which means that the engine 20 can be stopped, and at step 202 the engine 20 is stopped. It is to be noted that since T2 is small if the engine 20 is stopped immediately upon establishment of dT<T2 frequent repetitive starting and stopping of the engine 20 is induced which is not desirable. Thus, even though the establishment of dT<T2 occurs, the engine 20 remains in operation during a minimum operation time duration which is regulated by Tmio. In contrast, the absolute value of T3 is relatively large, which fails to induce frequent repetitive starting and stopping of the engine 20 even though the engine 20 is stopped upon establishment of dT<T3.

At step S207, when both of the formulas (4) and (5) are invalid or not established, step S208 is executed to determine whether the required load value is less than the minimum power of the engine power control. If the result of step S208 is no, the control returns to step S206. If the result is yes, the control proceeds to step S301 (FIG. 5).

Figure 5:
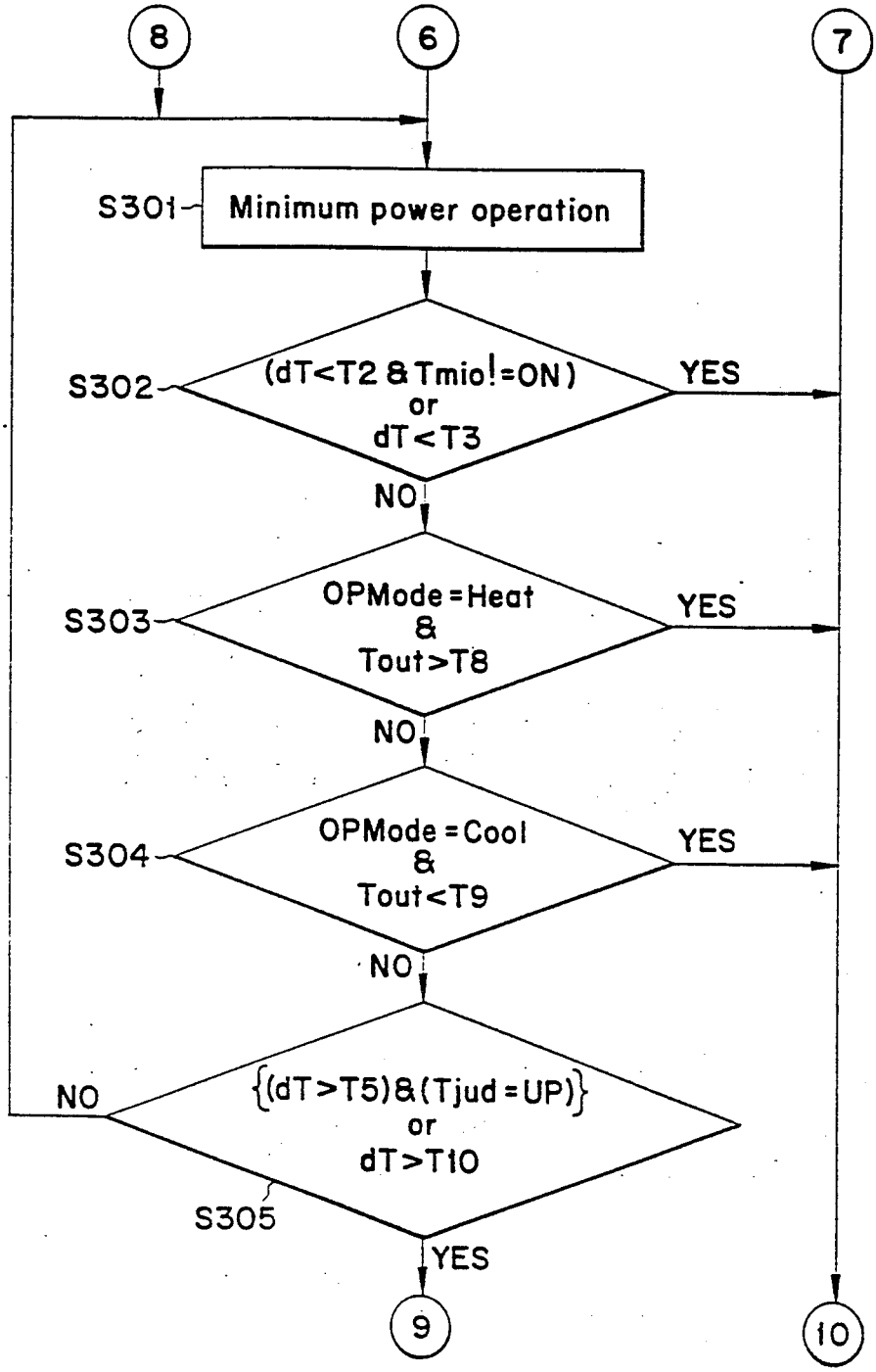
Figure 6:
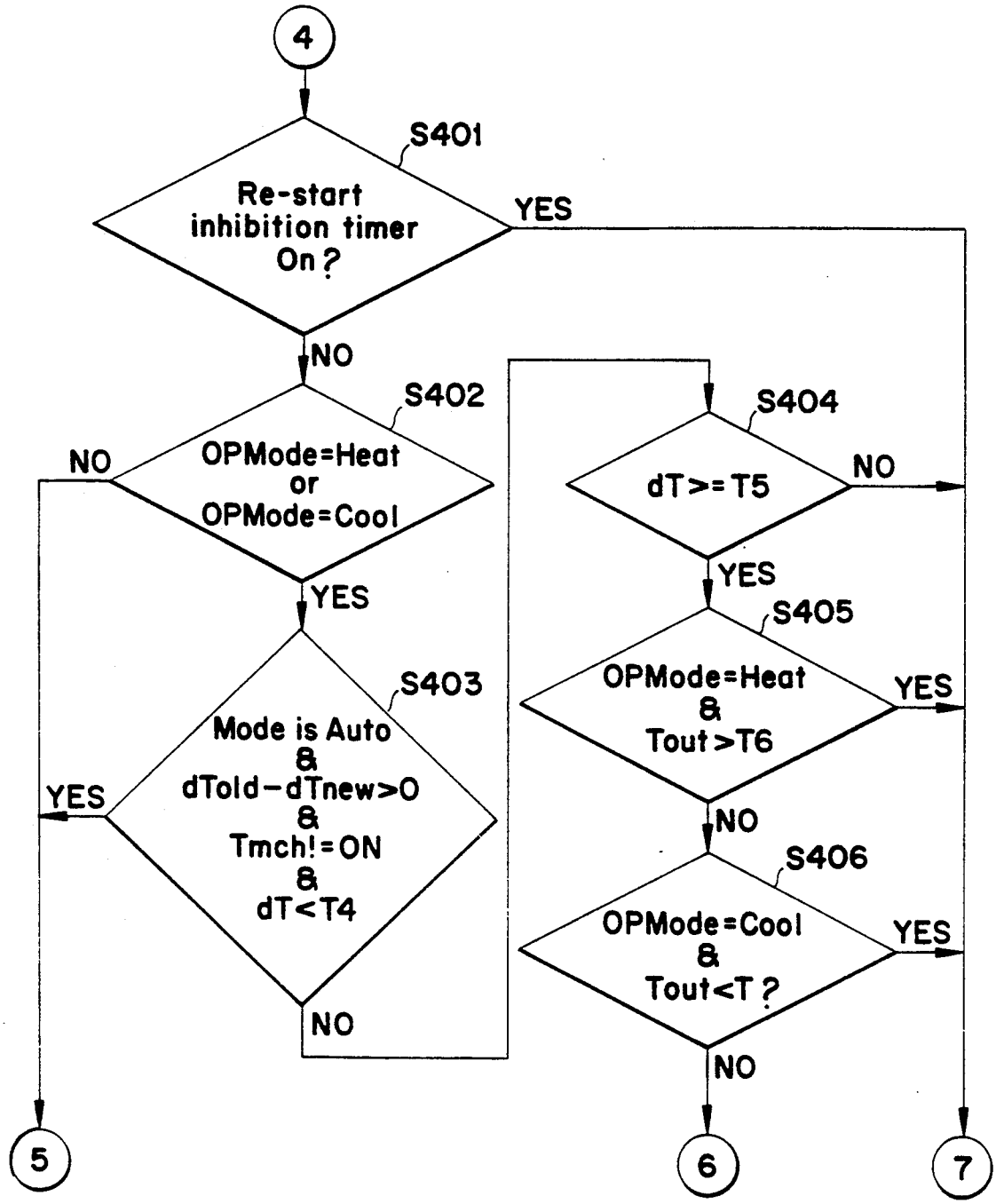

Referring to FIG. 5, the minimum power operation of the air conditioner 10 is performed by loop executions of steps S301, S302, S303, S304, S305, and S301. Within this execution loop, step S302 is executed whose function is identical to that of step S207. Thus, if one of the condition formulas (4) and (5) is valid or satisfied at step S302, Tset is attained, which permits the stopping of the engine 20. Then, the control proceeds to step S202 (FIG. 4), at which the engine 20 is stopped. If both of the formulas (4) and (5) are invalid at step S302, step S303 is executed. At step 303, it is determined whether under the condition of OPMode=Heat the following condition formula (6) is valid.

$$Tout>T8 \quad (6)$$

If this condition is satisfied, Tout is considerably high which means that no further heating operation of the air conditioner 10 is required, and step S202 is executed for stopping the engine 20. If the condition in step 303 is not satisfied, the control proceeds to step S304, at which under the condition of OPMode=Cool it is determined whether the following condition formula (7) is valid or satisfied.

$$Tout<T9 \quad (7)$$

If this determination is yes, Tout is considerably low which means that no further cooling operation of the air conditioner 10 is required, and step S202 is executed for stopping the engine 20. If the determination in step S304 is no, the control proceeds to step S305. At step S305, it is checked whether at least one of the following formulas (8) and (9) is valid or established.

$$(dT>T5)\ \&\ (Tjud=UP) \quad (8)$$

$$dT>T10 \quad (9)$$

It is to be noted that each of T5 and T10 is a plus value of a temperature which requires air conditioning. In light of the fact that the absolute value of T5 is less than the absolute value of T10, the necessity of air conditioning at a condition under which dT>T10 is larger than that at another condition under which dT>T5. If either the condition formula (8) or (9) is valid or satisfied, Tset is not attained which means that normal operation control is required. Then, the control proceeds to step S209 in order to estimate a potential power of the air conditioner 10 under the current operation conditions, and returns to the foregoing normal operation control loop from step S205. Upon establishment of dt>T5, this means that Troom is less than Tset by at least T5. However, due to the fact that the absolute value of T5 is small, if the control returns to the normal operation control loop immediately upon establishment of dT>T5, Troom becomes Tset soon, which results in frequent repetitive starting and stopping of the engine 20 or return to the minimum power operation control loop. Thus, for the minimum time duration defined by Tjud which is in UP, the engine 20 is being driven. However, if the condition formula (9) is valid, this means that Troom is less than Tset by at least T10 whose absolute value is relatively large. Sufficient difference lies between Troom and Tset, which fails to induce frequent repetitive starting and stopping of the engine 20 or return to the minimum power operation control loop. Thus, regardless of the condition of Tjud, immediately upon establishment of the condition formula (9), the control proceeds to step S209 in order to estimate a potential power of the air conditioner 10 under the current operation conditions, and returns to the foregoing normal operation control loop from step S205. When both of the condition formulas (8) and (9) at step S305 are not satisfied, the control returns to step S301 for repeating the minimum power operation control loop.

After the engine 20 is stopped at step S202, the control proceeds to step S401 (FIG. 6) in order to determine whether the re-start inhibition timer is in the on-condition. If the determination in step S401 is yes, step S202 is executed and the rest of the engine 20 is maintained. If the determination in step S401 is no, step S402 is executed for determining whether OPMode=Heat or OPMode=Cool is valid or satisfied. If the result of step S402 is no, the control proceeds to step S102 (FIG. 3) and thereafter the foregoing procedures are performed. If OPMode=Heat or OPMode=Cool is satisfied, step S403 is executed in order to determine whether all of the following four conditions are valid or not.

Mode=Auto $$dTold-dTnew>0 \quad \text{condition formula (10)}$$

$$Tmch!=ON \quad \text{condition formula (11)}$$

$$dT<T4 \quad \text{condition formula (12)}$$

If the conditions are satisfied, step S102 (FIG. 3) is executed and thereafter the foregoing procedures are performed. If false or at least one of the foregoing four conditions is invalid, step S404 is executed in order to determine whether the following condition formula (13) is valid or not.

$dT \geqq T5$ condition formula (13)

If this condition formula (13) is not satisfied, the temperature difference between Troom and Tset is small, and therefore no air conditioning is required. Then, the control proceeds to step S202 for stopping the engine 20. If true, step S202 is executed for maintaining the engine 20 at rest. At step S404, if the condition formula (13) is satisfied, the control proceeds to step S405 and it is determined, under the condition of OPMode=Heat, whether the following condition formula (14) is valid or satisfied.

$Tout > T6$ condition formula (14)

If the condition formula (14) is satisfied, Tout is relatively high, and therefore no heating operation is required. Then, the control proceeds to step S202 for stopping the engine 20. Due to the fact that $T6 < T8$, Tout is higher when the control is within the minimum power operation mode than when the engine 20 is being stopped. Thus, while the engine 20 is being stopped, sufficiently lower Tout is required in order to re-start the engine 20. If the condition formula (14) is not satisfied, the control proceeds to step S406 in order to determine, under the condition of OPMode=Cool, whether the following formula (15) is valid or satisfied.

$Tout < T7$ condition formula (15)

If satisfied, Tout is relatively low, and therefore no cooling operation is required. Then, the control proceeds to step S202 for stopping the engine 20. Since $T7 > T9$, Tout is lower when the control is within the minimum power operation mode than when the engine 20 is being stopped. Thus, while the engine 20 is being stopped, sufficiently higher Tout is required in order to re-start the engine 20. If the condition formula (15) is not satisfied, the control proceeds to step S301 (FIG. 5) in order to execute the minimum power operation.

It is to be noted that after the engine 20 is stopped at step S202, if air conditioning is required the minimum power operation (cf. step S301 in FIG. 5) is established in principle except for the false decision at step S402 and the true decision at step S403.

As will be apparent from the foregoing disclosure, in accordance with the present invention, the following advantages are obtained.

(1) Since the first set temperature at which the operation of the air conditioner 10 is temporarily stopped is determined at a relatively high value during the minimum power operation, an immediate temporary stop of the operation is prevented and therefore sufficient air conditioning is established.

(2) Since the second temperature at which the operation of the air conditioner 10 is temporarily stopped is determined at a relatively low value during an operation other than the minimum power operation, excess air conditioning is prevented.

(3) When the air conditioner is re-started after a temporary stoppage, the operation is in the minimum power mode. Thus, an acceleration of the air conditioning toward the set temperature can be restricted, thereby preventing quick excess of the set temperature. This means that (4) The foregoing items (1), (2), and (3) reveal that frequent repetitive stopping and starting of the air conditioner is prevented, and discomfort of one or more persons can be avoided.

The principles, preferred embodiment, and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. An engine driven air conditioner for adjusting a temperature of an inner space of a room, comprising:

a coolant circuit having a compressor, a condenser, an expansion means, and an evaporator;

an engine driving the compressor; and control means controlling the coolant circuit and the engine in such a manner that the engine is driven at a minimum power operation or at a power operation other than the minimum power operation, the engine being stopped if the temperature exceeds a first set value while the engine is being driven at the minimum power operation, the engine being stopped if the temperature exceeds a second set value which is less than the first set while the engine is being driven after the minimum power operation, and the engine being driven at the minimum power operation when the engine is re-started after a temporary stop of the engine.

2. An engine driven air conditioner in accordance with claim 1, wherein the control means is in the form of a micro-processor.

3. An engine driven air conditioner in accordance with claim 2, wherein the control means is under a control of a remote controller.

* * * * *